US007287288B2

(12) United States Patent
Walker

(10) Patent No.: US 7,287,288 B2
(45) Date of Patent: Oct. 30, 2007

(54) PATIENT LIFTING DEVICE

(76) Inventor: Simon Christopher Dornton Walker, 34 Garland, Rothley, Leicester (GB) LE7 7 RF ( * ) Notice: Subject to any disclaimer, the term of this patent is extended or adjusted under 35 U.S.C. 154(b) by 0 days.

(21) Appl. No.: 11/608,006

(22) Filed: Dec. 7, 2006

(65) Prior Publication Data

US 2007/0094791 A1 May 3, 2007

Related U.S. Application Data

(63) Continuation of application No. PCT/GB2004/002529, filed on Jun. 12, 2004.

(51) Int. Cl.
*A61G 7/10* (2006.01)

(52) U.S. Cl. ..... 5/89.1; 5/83.1

(58) Field of Classification Search ..... 5/83.1, 5/87.1, 89.1, 81.1 R
See application file for complete search history.

(56) References Cited

U.S. PATENT DOCUMENTS

| | | | | |
|---|---|---|---|---|
| 3,568,226 | A * | 3/1971 | Mater et al. | 5/87.1 |
| 3,608,104 | A * | 9/1971 | van Gerven | 5/83.1 |
| 4,409,696 | A * | 10/1983 | Bakker | 5/87.1 |
| 4,510,633 | A * | 4/1985 | Thorne | 5/87.1 |
| 4,704,749 | A * | 11/1987 | Aubert | 5/87.1 |
| 5,325,550 | A * | 7/1994 | Dearstyne et al. | 5/89.1 |
| 6,192,534 | B1 * | 2/2001 | Restivo | 5/89.1 |
| 2004/0074414 | A1 | 4/2004 | Phillips | |
| 2007/0094791 | A1 * | 5/2007 | Walker | 5/81.1 R |

FOREIGN PATENT DOCUMENTS

| | | |
|---|---|---|
| DE | 85 27 201.9 | 1/1986 |
| DE | 43 13 494 | 10/1994 |
| FR | 2 636 232 | 3/1990 |
| GB | 757 340 | 9/1956 |
| GB | 2 105 677 | 3/1983 |
| GB | 2 396 147 A | 6/2004 |
| GB | 2 396 147 B | 1/2006 |
| WO | WO 84/02074 | 6/1984 |

OTHER PUBLICATIONS

International Search Report; International Application No. PCT/GB2004/002529; date of actual completion of the international search Feb. 25, 2005; date of actual mailing of the international search report Mar. 3, 2005, 4 pages.

* cited by examiner

*Primary Examiner*—Robert G. Santos
(74) *Attorney, Agent, or Firm*—Reinhart Boerner Van Deuren P.C.

(57) ABSTRACT

A patient lifting device is provided. The patient lifting device includes two side limbs connected to a suspension mounting for suspending the device from a hoist. Each side limb includes a support bar including patient support elements. The patient support elements include a pair of side pads for engaging beneath the armpits of a patient and against sides of the patient's ribcage, and a patient upper leg or posterior support means. The two support bars connect together with an assembly from which the patient upper leg or posterior support means depends. Each support bar is pivotally mounted about a pivotal axis defining a balance axis about which the moments imparted by the weight of the patient's upper body through the side pads and by the weight of the patient's lower body through the upper leg or posterior support means can react against one another in an equal and opposite fashion.

14 Claims, 4 Drawing Sheets

PATIENT LIFTING DEVICE

CROSS-REFERENCE TO RELATED PATENT APPLICATIONS

This patent application is a continuation of PCT/GB2004/002529 filed Jun. 12, 2004, designating the United States, the teachings and disclosure of which are hereby incorporated in their entireties by reference thereto.

FIELD OF THE INVENTION

This invention relates to a patient lifting device. It relates particularly to a device which is suitable for lifting and moving an individual, for example, a person whose ability to move themselves is temporarily or permanently restricted.

BACKGROUND OF THE INVENTION

Many patients in a hospital or home who are physically disabled find themselves needing to be moved frequently from a lying position to a sitting or standing position. Where the patient is unable to help themselves, the movement of the patient has to be carried out by the nursing staff or carers who have to manually lift and move the patient. The heavy work involved generally means that two nurses or carers are needed to hold the patient and often from doing this work these people themselves can suffer from back damage or back strain. Much of this lifting work is also done by the family members of patients in their own homes. Sometimes it is possible to use a wheeled or overhead electrical hoist unit to lift a patient from a bed but this requires the patient to be assisted into a sling to which the hoist may be attached. The sling needs to be passed like a hammock beneath the back of the patient and this task still requires the patient to be lifted and manipulated in order to fix the sling. There have been attempts to provide a lifting frame which could be attached to a patient who was lying face upwards on a bed. Such a frame would be able to be attached to a patient from the front side by hook support members arranged to be inserted under the armpits. One such frame is disclosed in U.S. Pat. No. 4,509,785 and this document describes a frame which is able to be attached to the hoist unit so that the patient may be mechanically lifted from a lying position. The patient is secured by a strap which is passed behind the back of the patient's body and then is connected to both support members. The patient can then be safely lifted to a sitting or standing position by operation of the hoist. When supported by the hoist, the patient may be moved to another bed or a chair so that an alternative resting position is available.

With the aforementioned lifting frame, the patient is suspended from the chest region and there is no special provision to support the lower part of the body. The present invention was devised to be able to include a lower body support which would be adjustable for different sizes of patient and be able to assist with different patient needs such as bathing and toilet requirements.

A lifting frame which incorporates both underarm supports and support members for supporting the patient's lower torso by hooking beneath the patient's knees is disclosed in DE-A-4313494. As with U.S. Pat. No. 4,509,785, the underarm supports are part of a scissor-like framework the design of which ensures that the weight of the patient causes the underarm supports to press inwardly against the patient's sides so as to grip and support the patient by pressure against the upper rib-cage. However both are most unsuitable for lifting patients from a position in which they are lying flat on their backs, and also are unsuitable for amputees with no lower limbs.

There is therefore a great need for a lifting frame which avoids the disadvantages of the prior art, and which can be used in place of a fabric sling in a wide variety of lifting situations and with a wide variety of patients.

BRIEF SUMMARY OF THE INVENTION

In one embodiment, the invention provides a patient lifting device including two side limbs. Each side limb is connected at an upper end to a suspension mounting for suspension of the device from a lifting hook of a hoist. Each is provided at a lower end with a support bar which mounts patient support elements. The patient support elements being (i) a pair of side pads for engaging beneath the armpits of a patient and against opposite sides of the patient's ribcage, and (ii) a patient upper leg or posterior support means. The two support bars are connected together by a link bar assembly from which the patient upper leg or posterior support means depends. Each support bar is pivotally mounted on its side limb about a pivotal axis, defining a balance axis about which the moments imparted by the weight of the patient's upper body through the side pads and by the weight of the patient's lower body through the upper leg or posterior support means can react against one another in an equal and opposite fashion.

In another embodiment, the link bar assembly may be provided with an adjustment means effective for adjusting the distance setting between the supports. The patient upper leg or posterior support means preferably comprises a column including an adjustable patient upper leg or posterior support unit. The link bar assembly may support the column from a rotatable tee-piece such that the column and upper leg unit is able to be removed and repositioned when necessary. The column may be adjustable for setting a required column length. Different patient upper leg or posterior support units may be readily and interchangeably secured to the column to support different patients.

In another embodiment, the side pads may be selectively rotatably or fixedly mounted on the support bars, rotation when permitted being about the support bar longitudinal axes. The rotation may be permitted by a stop pin passing through the support bar alone, or prevented by passing that stop pin through both the support bar and a side support assembly linking the support bar to the associated side limb. The same side pad support assemblies connected to the side limbs may additionally provide a fixing for the link bar assembly.

The range of seat models may include, but is not limited to, a waterproof seat, a padded seat and a toilet seat. A selected seat model may be secured to the seat fitting by a clip fastener.

In a further embodiment of the invention, the patient lifting device carries a resilient padding cover on its major surfaces. The suspension mounting may be a connection means by which the lifting device may be readily coupled to any conventional lifting boom or connection of a patient hoist unit.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
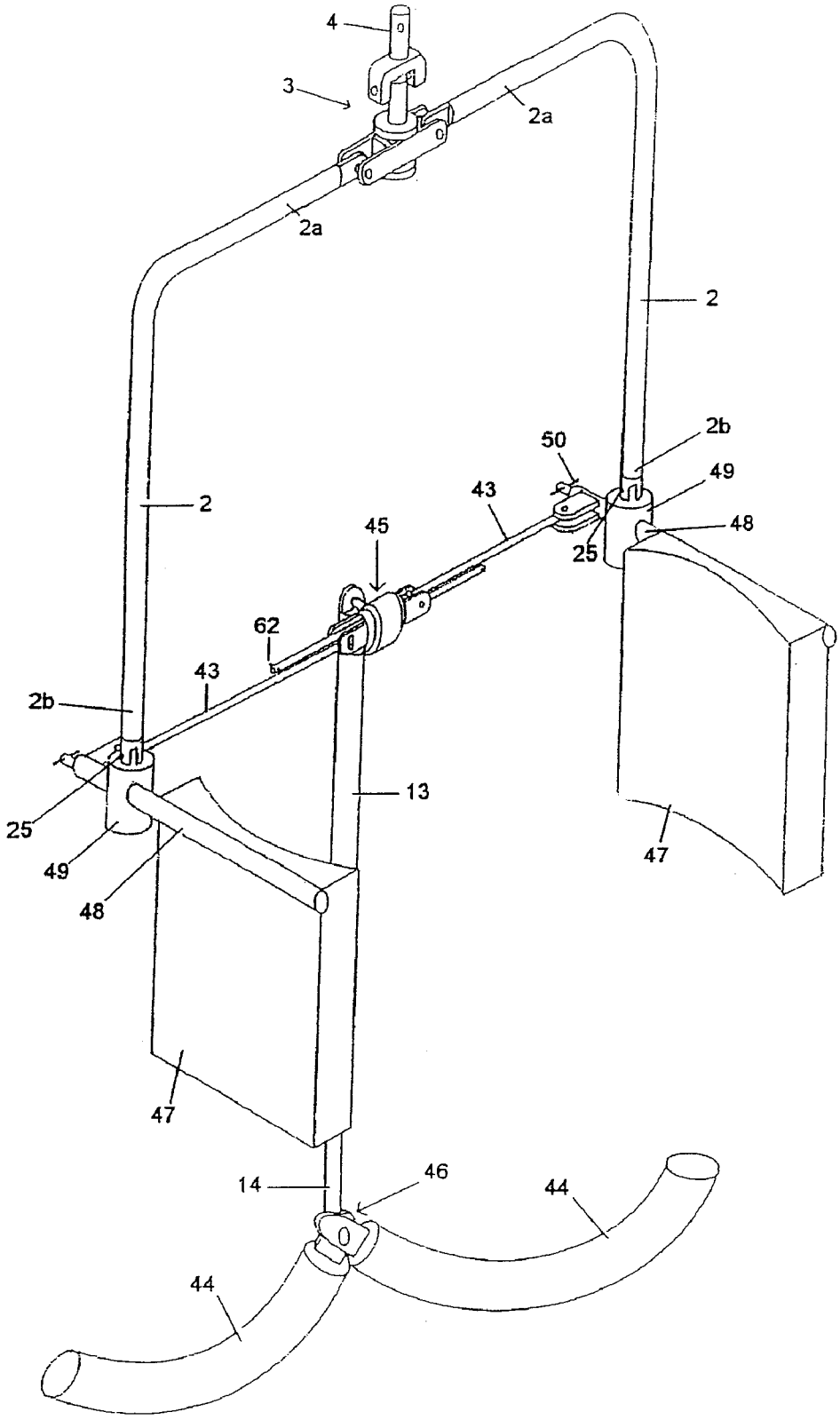
FIG. 1 is a perspective view of the patient lifting device.

As depicted in FIG. 1, the patient lifting device 1 is constructed from a range of steel tube and rod material. The device has two side limbs 2 which are both connected at their upper ends 2*a* by pivots to a linkage 3 and this component carries a fastener 4 by which the device may be coupled to a lifting boom or connection piece (not shown) of a patient hoist unit.

The side limbs 2 extend downwards from the linkage 3 in the shape of an inverted letter U and the lower ends 2*b* of the side limbs 2 are connected to side support assemblies 49 as described in greater detail below. Passing centrally through each side support assembly 49 is a support bar 48 which forwardly of the associated side support assembly mounts one end of a link bar assembly 43,45.

The link bar assembly 43,45 is formed from two mutually parallel rods 43 which are coupled together by a tee-piece in the form of a connector assembly 45. The rods 43 are thus retained parallel to one another by the connector assembly 45 and they are able to be expanded outward or moved inward in order to allow the lower parts of the limbs 2 to be moved further apart or closer together. This will allow the lifting device to be adjusted to accept different patients having broader or narrower chest widths.

Figure 5:
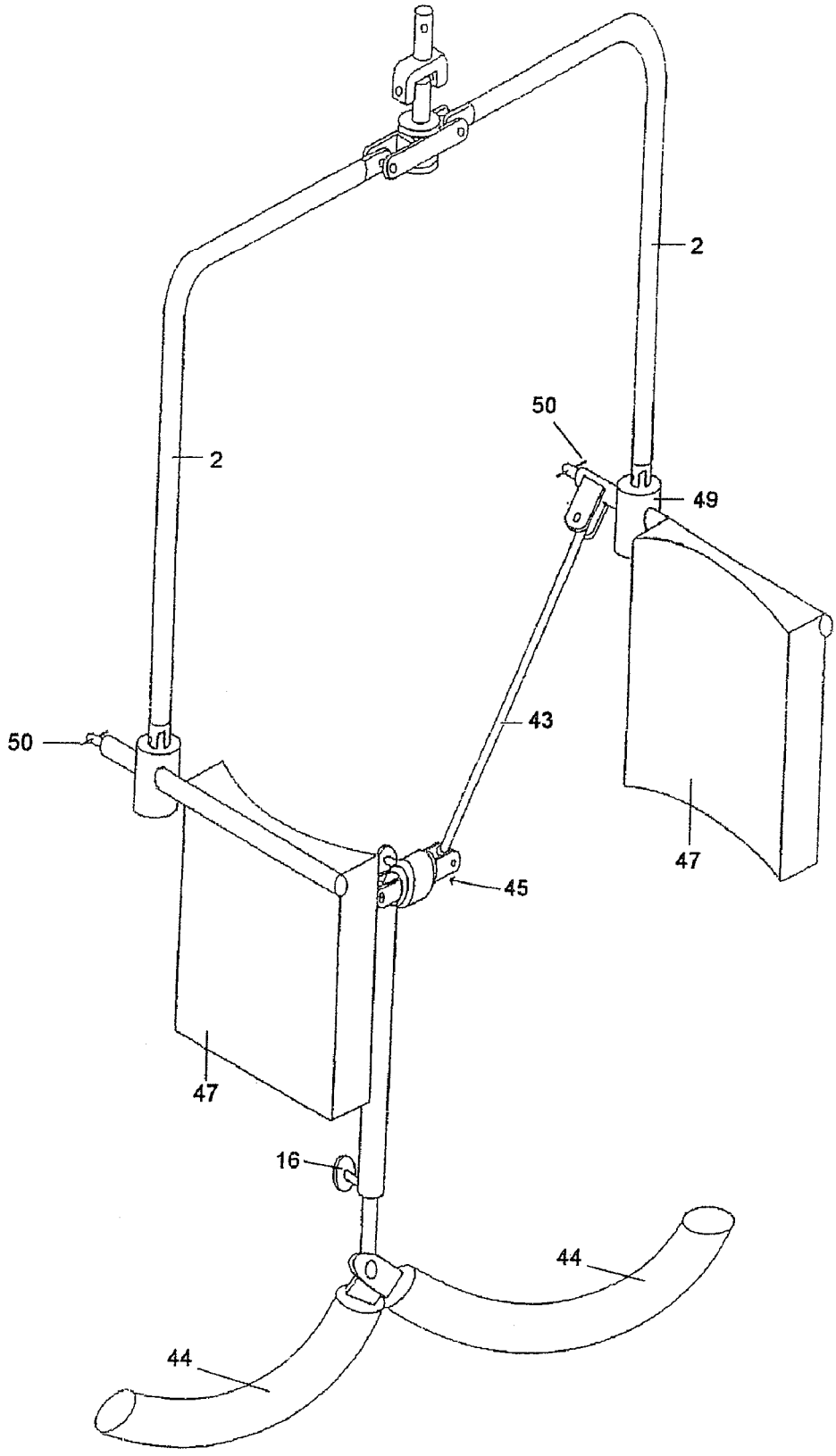
FIG. 5 shows the embodiment of FIG. 1 in an alternative attitude for holding a patient.

The tee-piece 45 (which corresponds to the floating collar 66 of FIG. 6) supports a rigid column 13 which extends in a direction away from the linkage 3. The column 13 is adjustable in length by means of a column extension 14 which can be fixed by a clamp screw 16 (FIG. 5). The column 13 is mounted on a lower arm 61 of the tee-piece 45 (or 66) in such a way that the major axis of the column 13 is rotatable about both the vertical axis of the tee-piece lower arm and also horizontal axis of the link bar assembly 43,45 (or 64,66).

At its lower end, the column extension 14 terminates in two curved padded bars 44 which are connected at a pivot point 46 which serves to retain them in a roughly straight line attitude. The two curved bars 44 are covered with a padding layer so that they will be able to be passed beneath the upper leg bones of a patient supported in the lifting device. This pivot point 46 also has an adjustment control so that the two curved padded bars 44 may be arranged to be tilted slightly upward or downward to suit the leg structure of an individual patient.

In use of the patient lifting device, it will be assumed that the patient is initially lying face upwards in a bed. The lifting device is first connected to a lifting boom or connection piece of a patient hoist unit. The lifting device is then brought over the patient and the side pads 47 are engaged under the patient armpits with the column 13 lying over the front of the patient body. The length of the link bar assembly 43,63 is adjusted as necessary. At this stage, it is possible to pass a security strap around the back of the patient's body and to attach and adjust this strap to back strap connectors (not shown) located on the side pad supports. The hoist unit is then operated to bring the patient gently up into a sitting position. The patient is then securely held by the lifting device. The column extension 14 length is adjusted as necessary and fixed by use of the clamp screw 16 to enable the padded bars 44 to be properly positioned. The padded bars 44 will of course be located at the base of the patient's back and this will help to support the weight of the lower body of the patient. Upon lifting the patient further, the patient's full weight will thus be divided between the side pads 47 and the padded bars 44.

The patient will then be in a comfortable position and they may be wheeled or moved on the hoist to a chair, to another bed or to the bathroom. The patient may also be moved between the bed, bath, toilet, swimming pool, wheelchair, floor surface, or chair, and from a lying to a sitting position as may be necessary.

The patient can be returned to the bed after a suitable interval and the hoist and lifting device can be moved away.

After making use of the patient lifting device, this may be detached from the patient hoist and, by turning the rotatable mountings for the side pads 47, these parts may be folded inwards to allow the unit to be stored easily and compactly. A suitable storage case for the lifting device may be provided to enable it to be carried and transported with ease.

Alternatively, the lifting device may be stored in a condition where it remains connected to the hoist. If this is the choice, the column extension 14 may be shortened in length by using the clamp screw 16 to loosen and secure it as appropriate. It may then be swung around to enable the column extension 14 end to be secured in a C-clip fastener (not shown) attached to the linkage 3. The lifting device can then remain in this compact attitude until further use is required.

In FIG. 1, the side limbs 2 carry a cross-bar which is formed from two mutually parallel rods 43 which are coupled together by a tee-piece in the form of a connector assembly 45. The rods 43 are thus retained parallel to one another by the connector assembly and they are able to be expanded outward or moved inward in order to allow the lower parts of the side limbs 2 to be moved closer together or further apart. This will allow the lifting device to be adjusted to accept different patients having narrow or broader chest widths.

The column extension 14 terminates in two curved padded bars 44 which are connected at a pivot point 46 which serves to retain them in a roughly straight line attitude. The two curved bars 44 are covered with a padding layer so that they will be able to be passed beneath the upper leg bones of a patient supported in the lifting device. This pivot point 46 also has an adjustment control so that the two curved padded bars 44 may be arranged to be tilted slightly upward or downward to suit the leg structure of an individual patient.

The side pads 47 and their attachment to the side support assemblies 49 will now be described in greater detail. The side pads 47 are as already described supported on support bars 48 which extend transversely from the lower ends 2*a* of the side limbs 2 via side support assemblies 49. Each support bar 48 passes through a side support assembly 49. The side pads 47 are generally rectangular in shape but they have a concave portion where they would come into contact with a patient's side chest area. The side pads 47 will therefore provide a large area of contact between the lifting device and the patient's body so that they can be expected to provide a comfortable hold when the patient is required to be lifted. In the embodiment of FIG. 1, the support bars 48 supporting the side pads 47 are shown to be straight but of course in a different embodiment the support bars could be curved so that they would function more as armpit supports.

When lifting a patient with the device of FIG. 1, each side support assembly 49 will first be fitted with side pads 47 of a suitable size for the relevant patient. The side pads 47 are provided in small, medium and large sizes and the pads can be readily interchanged on the support bars 48. The side pads on the support bars 48 can then be fitted through the side support assemblies 49 and secured with locking pins 50.

Each side pad can then be fitted beneath the patient's armpits so that they will lie on either side of the patient's chest. In adjusting the side pads for a patient chest width, the movement of the two ends of the limbs 2 will cause the parallel rods 43 of the link bar assembly to be shortened by an overlapping action which occurs within the connector assembly 45. If the patient is then partially lifted by the operation of the hoist (not shown), the cross-bar will become locked in the set position as a result of the patient's weight being applied to the connector assembly 45, as will become apparent in the later detailed description of the link bar assembly.

Security straps (not shown) which are adjustable in length are secured to appropriate strap connectors (also not shown) located at the upper and lower corners of the side pads 47. When the lifting device is used in this way, the amount of side pressure applied by the side pads 47 to the patient's chest will be controlled by the tightness of these security straps which are connected between the two side pads 47.

When it is required to fit a security strap across the back of a patient who is in a lying position, it may be necessary to partly lift the patient and then push the strap behind the back of the patient by using a flat metal bar coated with a low friction padding material.

Following this stage it is then that the padded curved bars 44 are placed in position under the upper leg bones of the patient. The relevant angle of the padded curved bars 44 can then be attained using the adjustment control around pivot point 46 to suit the leg profile of the patient. The column extension 14 attached to the padded curved bars can then be adjusted in length and fixed using screw clamp 16 according to patient size and shape. On each side of the padded curved bars 44 it may be possible to place a security strap (not shown) for use where the patient is an amputee on one or both of the lower limbs. This may also be of use where the patient has no strength or control in the lower limb area. This will prevent the patient from becoming detached when lifted.

Figure 2:
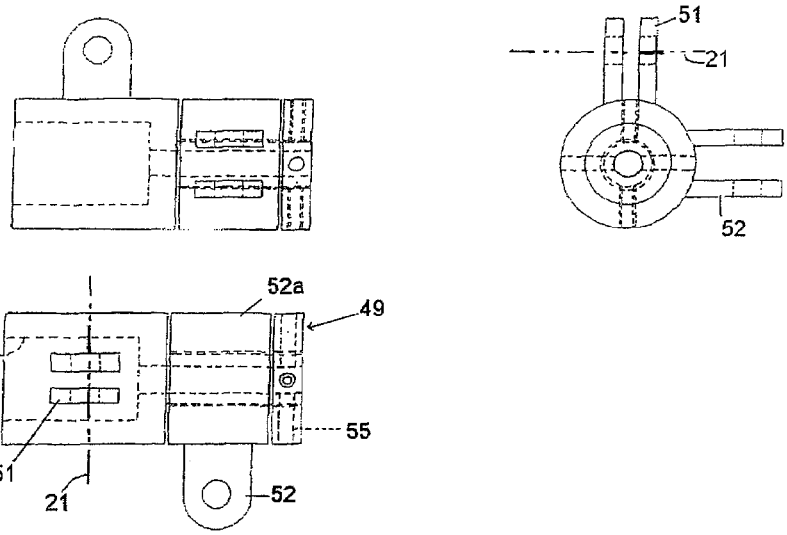
FIG. 2 is a detail of a side support assembly of FIG. 1.

FIG. 2 shows the side support assembly 49 in side, end and plan views. One such assembly 49 is fitted to the bottom end 2*b* of each of the two side limbs 2. Each side support assembly 49 has two lugs 51 which are pivotally attached by a pin (25, visible in FIG. 1) to the bottom end 2*b* of its respective side limb 2. The assembly also has two lug members 52 to which the outer end of each rod 43 is pivotally coupled, also by a pin fixing. The lug members 52 are mounted on a connection collar 52*a* which is freely rotatable about the longitudinal axis of the side support assembly 49. A stepped bore 53 is provided for retaining the support bar 48 which supports the side pad 47 and the support bar 48 is then secured in the stepped bore 53 by a locking pin 50 (FIG. 1). A further bore in the support assembly 49 provides a locking pin hole 55.

Figure 3:
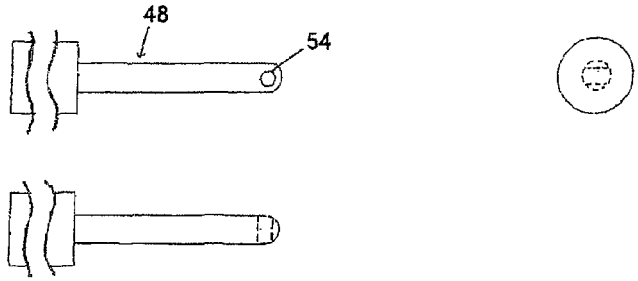
FIG. 3 is a detail of a support bar and side pad connection post.

FIG. 3 depicts the support bar 48 in side, end and plan views. The full length of the left hand part of the support bar 48 has not been shown in FIG. 3. At its right hand end, the support bar 48 has a narrow portion which is intended to pass through the bore 53 of the side support assembly 49 and it will then be secured in this bore by fixing a locking pin through a post hole 54. The locking pin 50 therefore passes through the locking pin hole 55 in the side support assembly 49 (FIG. 2) and through the post hole 54. Each locking pin 50 for the support bar 48 is made to be easily removable so that each side pad 47 and support bar 48 can be readily interchanged when a different size of side pad is required for a new patient. This arrangement of side support assembly 49, support bar 48 and locking pin hole 55 enables the side pads to be fixed in a position parallel to the limbs 2 when the locking pins 50 are placed in this position.

If desired, the pins 50 can be removed and the posts 48 moved forward such that the narrow portions of the posts 48 will have passed completely through the side support assemblies 49. When the pins 50 are placed back only through the post holes 54 and not the side support assemblies 49 this enables the complete free rotation for both the side pads 47 and posts 48 about the centre axis of the side support assemblies 49.

Figure 4:
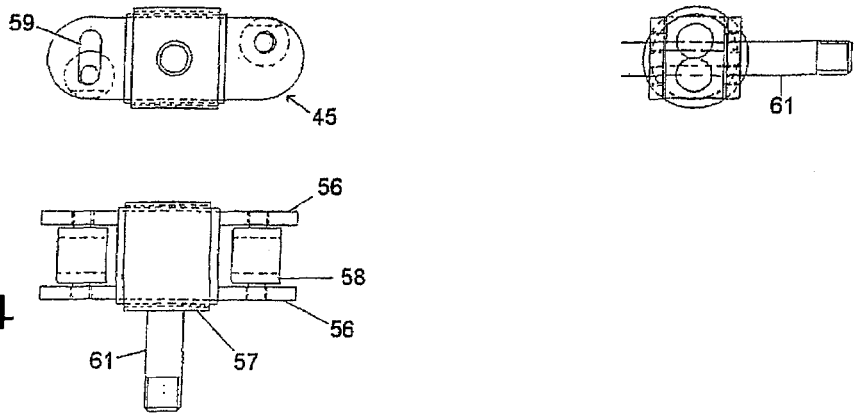
FIG. 4 shows a detail of a tee-piece of the link bar assembly of FIG. 1.

FIG. 4 depicts the connector assembly 45 of the link bar assembly in side, end and plan views. The connector assembly 45 has two side plates 56 which are held spaced apart from one another by a centre rotational boss 57. At the right hand end, a hollow collar 58 is mounted with a pivot pin extending into each side plate 56 such that the collar 58 can be rotated about the pivot pin. The internal opening in the collar is of such a diameter that one of the rods 43 from the side support assemblies 49 may be passed through the collar 58 and will then extend along the length of the assembly 45 and beyond the assembly opposite end. The internal opening provides a mounting for the rod 43 which will allow the rod to be easily slid through the opening in the connector assembly 45. The rod 43 is provided with a stop pin 62 on its end remote from its side support assembly 49 so that it will not be able to be pulled completely through the collar 58. Similarly, at the left hand end of the connector assembly, a second hollow collar provides a similar mounting for the rods 43 at the side closer to the other side support assembly 49. This second hollow collar has its pivot pins located in slots 59 in the side plates so that the respective rods from the side support assemblies will be able to be brought into contact with the bottom surface of the opposite collar 58, locking their sliding movement together or apart if a downward force should be applied to the connector assembly 45. The two pivoted collars 58 therefore hold the rods 43 in parallel relationship under freely sliding conditions if no downward force is applied to the connector assembly. If a downward force should be applied, however, the rods will tend to be pressed against both collars 58 and they will become locked so they can no longer be moved relative to one another.

The connector assembly 45 additionally carries a support pin 61 for the rigid column 13. This pin extends horizontally from the connector assembly and the column 13 is then attached at right angles to this pin 61.

FIG. 5 shows the lifting device of FIG. 1 after some parts have been repositioned to modify the lifting characteristics. The rods 43 from the side support assemblies 49 have been drawn outwards from the connector assembly 45 and when fully withdrawn, the stop pins 62 (FIG. 1) on the distal end of each rod will prevent that rod from being fully passed through its pivoted collar 58. The rods 43 are then able to be moved downwards since they are fixed to the members 52 which are located on connection collars 52*a*rotatable about the axis of the side support assemblies 49. The connector assembly 45 will then be located in a stable position some distance beneath the ends of the limbs 2. The adjustable column extension 14 will of course need to be shortened somewhat to enable the padded curved bars 44 again to be located beneath the upper leg bones of the patient.

When the lifting device in this form is intended to be fitted to a patient, it will be clear that when the weight of the patient is applied to the curved bars 44, this weight will tend to pull the ends of the limbs 2 closer together and thus the side pads 47 will engage the rib cage of the patient more tightly. It is more appropriate for the side pads 47 to be fitted in the fixed position parallel with each limb 2. This required each locking pin 50 (FIG. 1) to pass through each locking pin hole 55 and each post hole 54.

Whenever lifting takes place in either of these previously described modes (with the side pads 47 rotational about or fixed to the side support assemblies 49), a balance effect takes place. This is so that when the patient's upper body is lifted from one end of the side support assemblies 49 and the lower end is lifted from the opposite end of each side support assembly, an equal and opposite moment can be achieved about the centre lugs 51 connected to each side limb 2. The pin 25 passing through each pair of centre lugs 51 defines a pivotal axis for the associated support bar 48 and a balance axis 21 for the lifting apparatus. This effect helps to retain the patient in a more dignified upright sitting position when lifted. Instructions for correct operation of the lifting device can be placed for example on the outside edge of the side pads 47.

For patients who require a head support, this may be provided by attaching a head support strap consisting of a padded head or neck unit which is secured to both the limbs 2 of the lifting device. For patients who require walking practice, the lifting device also offers this facility. It may be achieved by removing the padded curved bars 44 enabling the patient legs and buttocks to hang freely. Upper support is maintained using the side pads 47 and security straps (not shown). With the use of a treadmill or equivalent, the patient may exercise to gradually gain strength, ability and the confidence to walk naturally by lowering the patient lifting device at the desired rate.

The patient lifting device has been found to be inexpensive to manufacture considering the many benefits it offers and it provides a very convenient aid for lifting a disabled person in safety. It can enable the lifting task to be carried out in safety by one helper instead of two or more and it avoids the need for that helper to do any heavy physical lifting with their own body. A major part of the effective lifting effort is able to be carried out by the patient hoist. The task of lifting a heavy person from ground level, bed, wheelchair, chair, bath, toilet or pool can be made very much lighter for the helper and more dignified for the patient. The risk of the helper or the patient being injured as a result of attempting the lifting operation can be much reduced. Since the lifting device is able to be used by a single operator this can give it advantages over the use of a lifting sling and enable the patient to be dealt with more quickly and simply. It is also capable of course of being used on patients who have fallen down and may require to be lifted from floor level. Since the lifting device is capable of being used with only a minimum of physical manipulation of the patient, this can enable the patient dignity to be greatly improved. When correctly used the patient will be moved in a more upright sitting position than that of most slings. Another advantage over slings is that the patient lifting device does not require any spreader bar as do most lifting slings. It also greatly improves body access areas for the carer whenever the patient is lifted as compared with the body access provided by most slings.

When not in use, the adjustable column extension 14 may be loosened and rotated through 1800 about the centre rotational boss 57. It can then be connected to a C-clip (not shown) fixed to the top linkage 3 of both limbs 2. This arrangement allows the unit to be stored in a compact neat position and if necessary to be detached and transported with ease in a suitable storage case.

The lifting device shown in FIG. 1 will be arranged with a resilient padding cover (not shown) which is intended to protect the patient and carer from coming into contact with hard metal surfaces. Concertina tubing may also be added around the link bar assembly where appropriate for the same reasons.

In a first modification of the lifting device, the cross-bar may be made from a telescopic unit which when fully extended has the option of becoming that of a 'V' shape. This works by the telescopic rod being hinged close to the centre end besides the piston within the tubular piece. The connection to the rigid column 13 can easily be fixed to or detachable from the tee-piece on the tubular section of this new cross-bar and it offers free rotation in all axes for the rigid column 13. It will still remain connected to the two lug members 52 on each side support assembly 49.

In a second modification, the side support assembly 49 can be made of one circular section instead of three as shown in FIG. 2 together with the two lugs 51 and two lug members 52 remaining. The simple difference is that the two lug members 52 are rotated through ninety degrees so that they lie in the same plane as that of the ends of the side support assembly. The angle of ninety degrees between the pivotal axes defined by the two lugs 51 and by the two lug members 52 remains unchanged. This change enables the cross-bar to operate in either a horizontal or 'V' shape as the two lug members 52 are now able to accept all relevant angles of cross-bar operation.

Figure 6:
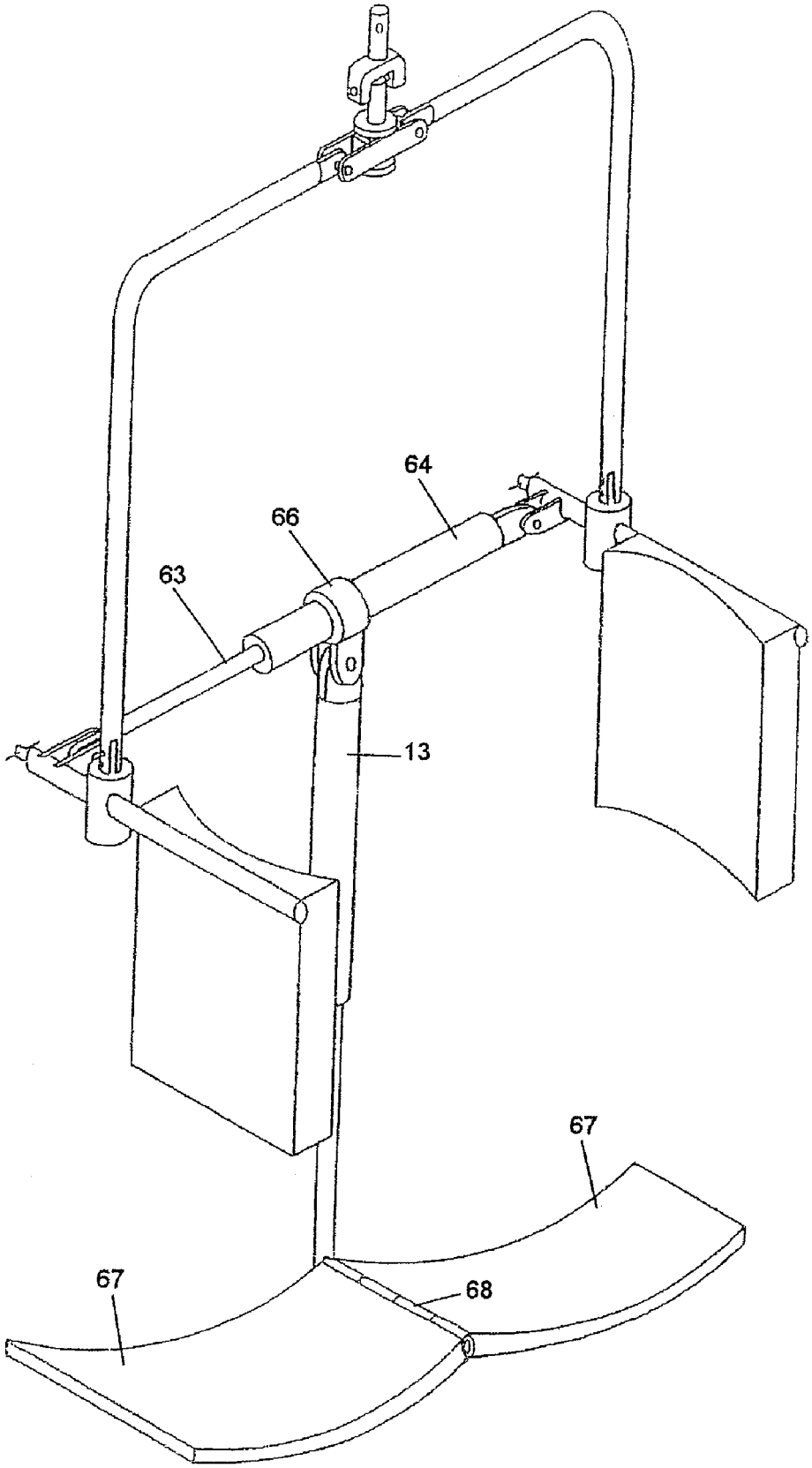
FIG. 6 is a different embodiment of the invention.

FIG. 6 shows a further modification of the device of FIG. 1. In the FIG. 6 construction, the connector assembly 45 and rods 43 are replaced by an extendable cross bar 63 having a telescopic construction and which is covered by a flexible concertina tubing material 64. An outer wall of the tubing material 64 supports a floating collar 66 which is able to be freely moved along the length of the cross bar 63 and which can also be rotated round the bar, if necessary. The collar 66 carries the column 13 and at a lower end of the column, a support means for the lower body of a patient is provided by a pair of curved plates 67 connected by a hinge 68. The curved plates 67 are able to be fitted either under the patient posterior or under the patient upper legs when the device is in use.

The curved plates 67 are able to be folded about the hinge so that they confront one another to make the lifting device more compact for storage purposes. In addition, the mounting of the plates 67 on the column 13 allows the plate and hinge combination to be rotated around the column 13. The hinge 68 may also be folded on its mounting so it will be able to lie parallel to the length of the column 13 for storage.

The foregoing description of embodiments of the invention has been given by way of example only and a number of modifications may be made without departing from the scope of the invention as defined in the appended claims. For instance, the lifting device could be provided with an electronic patient weighing unit located in the area of the fastener 4 at the junction of the limbs 2. The cross-bar 63 could be made so that it was readily separable from the limbs 2, for example for cleaning or storage purposes. The side pads 47 may be provided in a small range of different sizes so that the most suitable side pad can be selected for optimum patient comfort.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having", "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A patient lifting device comprising:

two side limbs each connected at an upper end to a suspension mounting for suspension of the device from a lifting hook of a hoist and each provided at a lower end with a support bar which mounts patient support elements;

the patient support elements being (i) a pair of side pads for engaging beneath the armpits of a patient and against opposite sides of the patient's ribcage, and (ii) a patient upper leg or posterior support means;

wherein the two support bars are connected together by a link bar assembly from which the patient upper leg or posterior support means depends; and wherein each support bar is pivotally mounted on its side limb about a pivot axis, defining a balance axis about which the moments imparted by the weight of the patient's upper body through the side pads and by the weight of the patient's lower body through the upper leg or posterior support means can react against one another in an equal and opposite fashion.

2. A lifting device as claimed in claim 1, in which the link bar assembly is provided with an adjustment means effective for adjusting the distance setting between the support bars.

3. A lifting device as claimed in claim 2, in which the link bar assembly includes a column, a lower end portion of which is attached to an adjustable patient upper leg or posterior support unit.

4. A lifting device as claimed in claim 3, in which the link bar assembly supports the column from a rotatable tee-piece from which the column and upper leg or posterior support unit can be removed but reconnected when necessary.

5. A lifting device as claimed in claim 3, in which the column is adjustable in length.

6. A lifting device as claimed in claim 5, in which different upper leg or posterior support units can be readily and interchangeably secured to the adjustable length column.

7. A lifting device as claimed in claim 1, in which the side pads are either fixedly mounted on the support bars or rotatably mounted thereon to rotate about the longitudinal axes of the respective support bars.

8. A lifting device as claimed in claim 7, in which the mounting of each side pad on its support bar incorporates a stop pin which can pass through either the support bar alone to permit rotation of the side pad about the longitudinal axis of the support bar or through both the support bar and a side support assembly, which links the support bar to the associated side limb, to secure the side pad against rotation about the longitudinal axis of the support bar.

9. A lifting device as claimed in claim 8, in which each side pad connected to each side limb additionally provides a fixing for the link bar assembly.

10. A lifting device as claimed in claim 1, in which either or both of the side pads may be easily detached from the support bars and reconnected.

11. A patient lifting device comprising:

two side limbs each having an upper end and a lower end, of which each upper end is connectable to a suspension mounting for suspension of the device from a lifting hook of a hoist, and each lower end pivotally mounts a support bar that is mounted thereon to rotate about a pivot axis;

wherein each support bar mounts, on one side of its pivot axis, first patient support elements in the form of a pair of side pads for engaging beneath the armpits of a patient and against opposite sides of the patient's ribcage, and the two support bars are connected together, on the other sides of their respective pivot axes, by a link bar assembly which has depending therefrom a second patient support element, in the form of a patient upper leg or posterior support means;

wherein when a patient is lifted by the device the moments imparted on the support bars by the weight of the patient's upper body through the side pads and by the weight of the patient's lower body through the upper leg or posterior support means act on opposite sides of the pivot axes to react against one another in an equal and opposite fashion.

12. A lifting device as claimed in claim 11, in which the link bar assembly is adjustable in length for adjusting the distance setting between the support bars.

13. A lifting device as claimed in claim 12, in which the link bar assembly has, depending from a central portion thereof, a column which carries, at a lower end thereof, the second patient support element.

14. A lifting device as claimed in claim 13, in which the column is adjustable in length.

* * * * *